US012297844B2

(12) United States Patent
Lotz et al.

(10) Patent No.: US 12,297,844 B2
(45) Date of Patent: May 13, 2025

(54) CONTROLLED AREA PROGRESSION DIFFUSER

(71) Applicant: BorgWarner Inc., Auburn Hills, MI (US)

(72) Inventors: Robert Dirk Lotz, Asheville, NC (US); Robert Malcom Wallace, Chandler, NC (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 18/505,773

(22) Filed: Nov. 9, 2023

(65) Prior Publication Data

US 2024/0159245 A1 May 16, 2024

Related U.S. Application Data

(60) Provisional application No. 63/424,930, filed on Nov. 13, 2022.

(51) Int. Cl.
*F04D 29/44* (2006.01)
*F04D 17/10* (2006.01)

(52) U.S. Cl.
CPC ..... *F04D 29/441* (2013.01); *F04D 17/10* (2013.01)

(58) Field of Classification Search
CPC ..... F04D 29/441
See application file for complete search history.

(56) References Cited

U.S. PATENT DOCUMENTS

| | | | | |
|---|---|---|---|---|
| 3,289,921 | A | 12/1966 | Soo | |
| 3,658,437 | A | 4/1972 | Soo | |
| 3,997,281 | A | 12/1976 | Atkinson | |
| 4,181,466 | A | 1/1980 | Owen | |
| 4,382,747 | A | 5/1983 | Okano | |
| 4,900,225 | A | 2/1990 | Wulf et al. | |
| 5,143,514 | A | 9/1992 | Adachi | |
| 6,168,375 | B1 | 1/2001 | Larue | |
| 6,382,912 | B1 * | 5/2002 | Lee | F04D 29/441 415/224.5 |
| 6,695,579 | B2 | 2/2004 | Meng | |
| 8,157,516 | B2 | 4/2012 | Chen et al. | |
| 9,874,224 | B2 * | 1/2018 | Morita | F04D 17/10 |

(Continued)

FOREIGN PATENT DOCUMENTS

| | | | |
|---|---|---|---|
| DE | 102013017694 | A1 | 7/2014 |
| DE | 102015103615 | A | 4/2016 |

(Continued)

*Primary Examiner* — Justin D Seabe
(74) *Attorney, Agent, or Firm* — von Briesen & Roper, s.c.

(57) ABSTRACT

A controlled area progression diffuser for a compressor may be defined by a bearing diffuser face of a bearing housing and a compressor diffuser face of a compressor housing that are spaced apart by a diffuser width, and airflow from a compressor wheel enters the controlled area progression diffuser through a diffuser inlet, flows between the diffuser faces, and flows out of a diffuser outlet to a volute. The diffuser faces may be shaped so that the diffuser width decreases as the controlled area progression diffuser extends radially away from the compressor wheel toward the volute so that an annulus area of the controlled area progression diffuser does not increase linearly for at least a portion of a radial length of the controlled area progression diffuser.

14 Claims, 9 Drawing Sheets

(56) References Cited

U.S. PATENT DOCUMENTS

| | | | | |
|---|---|---|---|---|
| 10,066,638 | B2 | 9/2018 | Bessho | |
| 10,066,639 | B2 | 9/2018 | Annati et al. | |
| 11,092,165 | B2 | 8/2021 | Hayashi | |
| 11,125,235 | B2 | 9/2021 | Sivagnanasundaram | |
| 11,187,242 | B2 * | 11/2021 | Kuroda | F04D 17/12 |
| 11,408,439 | B2 | 8/2022 | Higashimori et al. | |
| 11,788,557 | B1 | 10/2023 | Swiatek | |
| 11,885,350 | B2 * | 1/2024 | Rusch | F04D 29/441 |
| 2002/0106278 | A1 | 8/2002 | Koga | |
| 2016/0097297 | A1 | 4/2016 | Twist et al. | |
| 2016/0108920 | A1 * | 4/2016 | Yamashita | F04D 17/10 415/204 |

FOREIGN PATENT DOCUMENTS

| | | | | | |
|---|---|---|---|---|---|
| DE | 102016217446 | A1 | | 3/2018 | |
| EP | 0341553 | A1 | | 11/1989 | |
| JP | 03260399 | A | | 11/1991 | |
| JP | 11294392 | A | | 10/1999 | |
| KR | 20100090114 | A | * | 8/2010 | F04D 29/441 |
| KR | 20110057736 | A | | 6/2011 | |
| WO | 2023078701 | A1 | | 5/2023 | |

* cited by examiner

CONTROLLED AREA PROGRESSION DIFFUSER

CROSS-REFERENCE TO RELATED APPLICATIONS

This application claims priority pursuant to 35 U.S.C. 119(e) to U.S. Provisional Application No. 63/424,930, filed Nov. 13, 2022, which application is incorporated herein by reference in its entirety.

TECHNICAL FIELD

The present disclosure relates generally to turbocharger systems for internal combustion engines and, more particularly, to compressor diffusers configured for efficient operation at low mass flow rates.

BACKGROUND

Turbochargers are used in numerous applications such as automotive, marine, and aerospace applications. Turbochargers operate by forcing more intake air into a combustion chamber of an internal combustion engine to improve the efficiency and power output of the engine. A turbocharger may generally include a compressor connected to a turbine by an interconnecting shaft. The turbine may extract energy from the flow of exhaust gases to drive the compressor via the interconnecting shaft, while the compressor may increase the pressure of intake air for delivery to the combustion chamber. The compressor may include a radial impeller that accelerates the intake air and expels the air in a radial direction, and a diffuser that slows down the expelled air to cause a pressure rise.

While effective, the operating range of turbocharger compressors may be limited to certain mass flow rates and pressure ratios outside of which the compressor may exhibit undesirable choke or surge behavior. In particular, the operating range of a compressor may be characterized by a map of operable mass flow rates and pressure ratios, with right and left boundaries respectively defining the choke and surge lines of the compressor. The choke line defines the maximum mass flow rate of the compressor, and the surge line defines the minimum mass flow rate of the compressor. Compressor surge occurs when the direction of flow through the compressor reverses to relieve pressure at the compressor outlet under low mass flow rate and high pressure ratio conditions. That is, at certain low mass flow rates and high pressure ratios, the flow can no longer adhere to the suction side of the blades, interrupting the discharge process and resulting in a pressure build up at the compressor outlet. The direction of air flow through the compressor may be reversed until a stable pressure ratio is reached, at which point the air flow proceeds in the forward direction again. This flow instability continues within the surge range of the compressor map and produces a noise known as "surging". Operating the turbocharger in surge for extended periods is undesirable, and may negatively impact the performance of the turbocharger.

SUMMARY OF THE DISCLOSURE

In one aspect of the present disclosure, a controlled area progression diffuser for a compressor is disclosed. The compressor may include a bearing housing in which a shaft is supported by a bearing to rotate about a rotational axis, a compressor wheel disposed on the shaft, and a compressor housing connected to the bearing housing and defining a chamber within which the compressor wheel rotates and a volute for receiving airflow generated by the compressor wheel. The controlled area progression diffuser may include a bearing diffuser face of the bearing housing having an annular shape and extending from the chamber to the volute, a compressor diffuser face of the compressor housing having an annular shape and extending from the chamber to the volute, wherein the bearing diffuser face and the compressor diffuser face are spaced apart by a diffuser width that is parallel to the rotational axis of the compressor wheel, a diffuser inlet proximate the chamber, and a diffuser outlet proximate the volute. The airflow from the compressor wheel may enter the controlled area progression diffuser through the diffuser inlet, flow between the bearing diffuser face and the compressor diffuser face, and flow out of the diffuser outlet to the volute. The bearing diffuser face and the compressor diffuser face may be shaped so that the diffuser width decreases as the controlled area progression diffuser extends radially away from the chamber toward the volute so that an annulus area of the controlled area progression diffuser does not increase linearly for at least a portion of a radial length of the controlled area progression diffuser.

In another aspect of the present disclosure, a compressor is disclosed. The compressor may include a bearing housing supporting a shaft by a bearing to rotate about a rotational axis, a compressor wheel disposed on the shaft, a compressor housing connected to the bearing housing and defining a chamber within which the compressor wheel rotates, a volute for receiving airflow generated by the compressor wheel, and a controlled area progression diffuser defined by a bearing diffuser face of the bearing housing and a compressor diffuser face of the compressor housing. The bearing diffuser face and the compressor diffuser face have annular shapes and extend from the chamber to the volute. The controlled area progression diffuser may include a diffuser inlet proximate the chamber and a diffuser outlet proximate the volute such that the airflow from the compressor wheel flows through the controlled area progression diffuser to the volute. The controlled area progression diffuser is shaped so that a diffuser width between the bearing diffuser face and the compressor diffuser face decreases as the controlled area progression diffuser extends radially away from the chamber toward the volute so that an annulus area of the controlled area progression diffuser does not increase linearly for at least a portion of a radial length of the controlled area progression diffuser.

In a further aspect of the present disclosure, a turbocharger is disclosed. The turbocharger may include a bearing housing in which a shaft is supported by a bearing to rotate about a rotational axis, a compressor wheel disposed on the shaft, a compressor housing connected to the bearing housing and defining a chamber within which the compressor wheel rotates, a volute for receiving airflow generated by the compressor wheel, and a controlled area progression diffuser defined by a bearing diffuser face of the bearing housing and a compressor diffuser face of the compressor housing having annular shapes and extending from the chamber to the volute. The controlled area progression diffuser may have a diffuser inlet proximate the chamber and a diffuser outlet proximate the volute so that the airflow from the compressor wheel enters through the diffuser inlet and exits through the diffuser outlet to the volute. The bearing diffuser face and the compressor diffuser face may be shaped so that a diffuser width between the bearing diffuser face and the compressor diffuser face decreases as the controlled area progression diffuser extends radially away from the chamber toward the volute so that an annulus area of the controlled area progression diffuser does not increase linearly for at least a portion of a radial length of the controlled area progression diffuser.

In a still further aspect of the present disclosure, a controlled area progression diffuser for a compressor is disclosed. The compressor may include a bearing housing in which a shaft is supported by a bearing to rotate about a rotational axis, a compressor wheel disposed on the shaft, and a compressor housing connected to the bearing housing, defining a chamber within which the compressor wheel rotates and a volute for receiving airflow generated by the compressor wheel. The controlled area progression diffuser may include a bearing diffuser face of the bearing housing having an annular shape and extending from the chamber to the volute, a compressor diffuser face of the compressor housing having an annular shape and extending from the chamber to the volute, wherein the bearing diffuser face and the compressor diffuser face may be spaced apart by a diffuser width that is parallel to the rotational axis of the compressor wheel, a diffuser inlet proximate the chamber, and a diffuser outlet proximate the volute. The airflow from the compressor wheel may enter the controlled area progression diffuser through the diffuser inlet, between the bearing diffuser face and the compressor diffuser face, and flow out of the diffuser outlet to the volute. The bearing diffuser face and the compressor diffuser face may be shaped so that an annulus area of the controlled area progression diffuser changes at a first rate as the controlled area progression diffuser extends radially away from the chamber toward the volute in a first portion of the controlled area progression diffuser, and the annulus area of the controlled area progression diffuser changes at a second rate as the controlled area progression diffuser extends radially away from the chamber toward the volute in a second portion of the controlled area progression diffuser.

Additional aspects are defined by the claims of this patent.

DETAILED DESCRIPTION

The following description of various embodiments is merely illustrative in nature and is in no way intended to limit the scope of the invention, its application or its uses.

Figure 1:
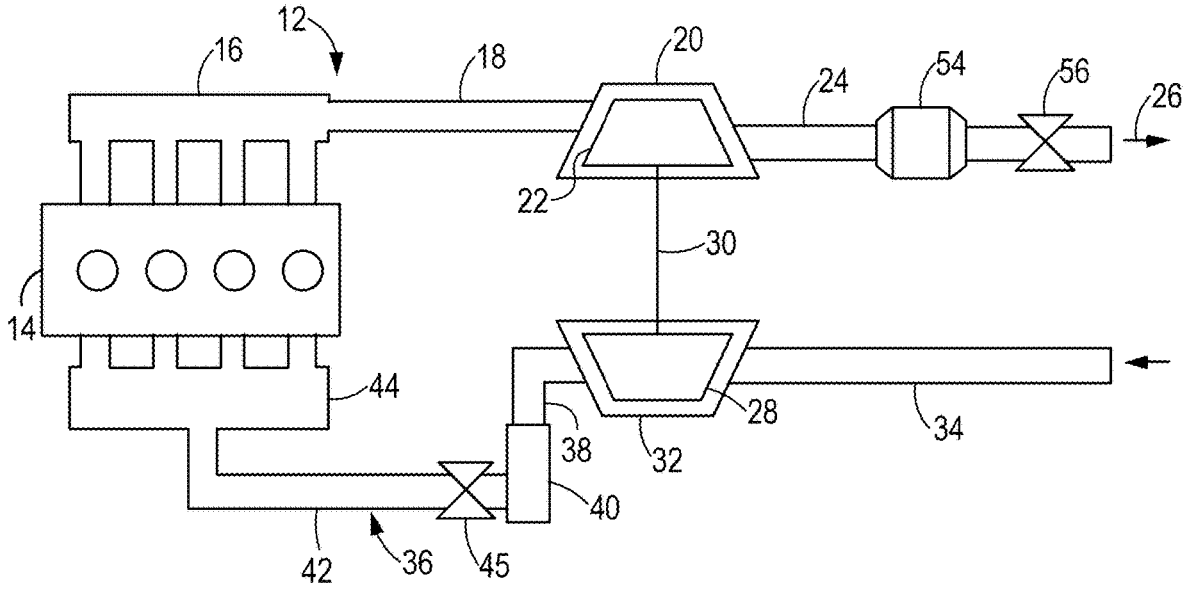
FIG. 1 is a schematic illustration of an engine airflow system including a turbocharger for an internal combustion engine.

As shown in FIG. 1, an engine airflow system 12 may include an internal combustion engine 14 that may have a number of cylinders for the controlled combustion of fuel to produce power. Exhaust gas generated during combustion may exit the engine 14 at an exhaust manifold 16 that may be connected to an exhaust passage 18. The exhaust passage 18 may lead to a turbine 20 of a turbocharger. The exhaust gas may be expanded in the turbine 20 and release energy to rotate a turbine wheel 22. The exhaust gas may continue from the turbine 20 through an exhaust passage 24, an exhaust after treatment device 54 and an exhaust throttle valve 56 to an exhaust discharge 26.

The turbine wheel 22 may be connected to a compressor wheel 28 directly or indirectly by a shaft 30. The compressor wheel 28 may be disposed in a compressor 32. Through the action of routing exhaust gases to rotate the turbine wheel 22, the compressor wheel 28 may be correspondingly rotated by the shaft 30. The rotating compressor wheel 28 may draw air in through an intake passage 34 and compress the air. Compression of the intake air may charge an intake system 36 of the engine 14 through a passage 38, a charge air cooler 40, a passage 42 and intake manifold 44. An intake throttle valve 45 may be provided to selectively throttle the passage 42 when desired, though the intake throttle valve 45 may be omitted in embodiments of the engine airflow system 12.

While controlled area progression diffusers according to the present disclosure are illustrated and described herein as being implemented in a turbocharger for an internal combustion engine, those skilled in the art will understand that the controlled area progression diffusers may be implemented in any centrifugal compressors used to boost the performance of a power source. For example, the controlled area progression diffusers may be implemented in electrically driven boosters that are driven by an electric motor as opposed to a turbine drive by combustion exhaust. Alternatively, controlled area progression diffusers may be implemented in fuel cell air supplies for electric vehicles that may or may not include a turbine. Further alternative implementations of controlled area progression diffusers according to the present disclosure in centrifugal compressors are contemplated by the inventors. Moreover, while the compressor 32 is described herein as drawing in, compressing and discharging air, compressor in accordance with the present disclosure may be implemented to compress any gas that flows through the process such as, for example, exhaust gas.

Figure 2:
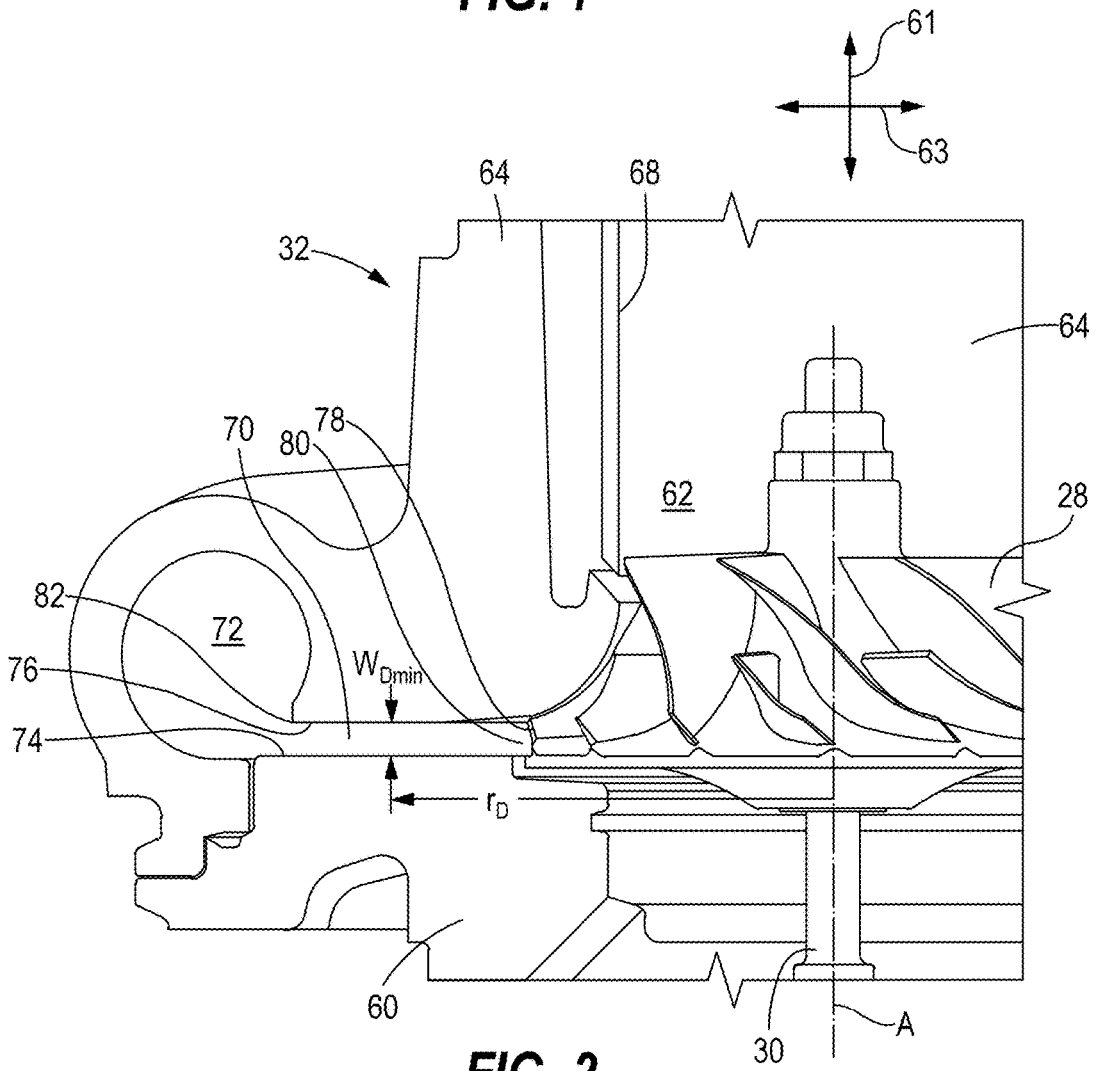
FIG. 2 is a partial cross-sectional view of a compressor of the turbocharger of the engine airflow system of FIG. 1.

An embodiment of a compressor 32 of a turbocharger is illustrated in FIG. 2. The description of the compressor 32 may include references to axial or axially, which is indicated by reference numeral 61 and means a direction along or parallel to a rotational axis A of the shaft 30. The description may further include references to radial or radially, which is indicated by the reference numeral 63 and means a direction toward or away from the rotational axis A of the shaft 30 in any of the 360 degrees around the shaft 30. The shaft 30 may be supported by bearings (not shown) in a bearing housing 60 that may be disposed between the compressor 32 and the turbine 20. The compressor wheel 28 may be disposed in a chamber 62 that may be defined by the bearing housing 60 and a compressor housing 64. A compressor inlet 68 to the chamber 62 may be defined by the compressor housing 64 through which air may be drawn by the compressor wheel 28. Air may be delivered from the compressor wheel 28 through a diffuser 70 and may be collected in a volute 72 for communication to the passage 38 via a compressor outlet (not shown). The diffuser 70 may be defined between the bearing housing 60 at a bearing diffuser face 74, and the compressor housing 64 at a compressor diffuser face 76. The diffuser 70 may form an annular passage extending radially outward from the chamber 62 at a compressor wheel tip 78 to the volute 72. Air drawn in through the compressor inlet 68 may be acted upon in the chamber 62 by the compressor wheel 28 and delivered through the diffuser 70 to the volute 72.

The flow of air leaving the compressor wheel tip 78 enters the adjacent segment of the diffuser 70 which may be referred to as a diffuser inlet 80, and exits the diffuser 70 to the volute 72 at a diffuser outlet 82. The diffuser inlet 80 is a segment of the diffuser 70 closest to the compressor wheel 28, which also has the highest gas flow velocity since the annulus area $A_D$ of the diffuser 70 is smaller radially inward, and becomes greater moving radially outward. The annulus area $A_D$ of the diffuser 70 at a given radial distance $r_D$ from the axis A of the compressor wheel 28 may be determined by the following equation:

$$A_D=2\pi r_D{*}w_D \tag{1}$$

where $w_D$ is a width of the diffuser 70 at a given radial distance $r_D$. In the compressor 32 of FIG. 2, the diffuser 70 has a conventional design wherein the diffuser width $w_D$ is constant as the diffuser 70 extends radially from the diffuser inlet 80 to the outlet to the volute 72.

Figure 3:
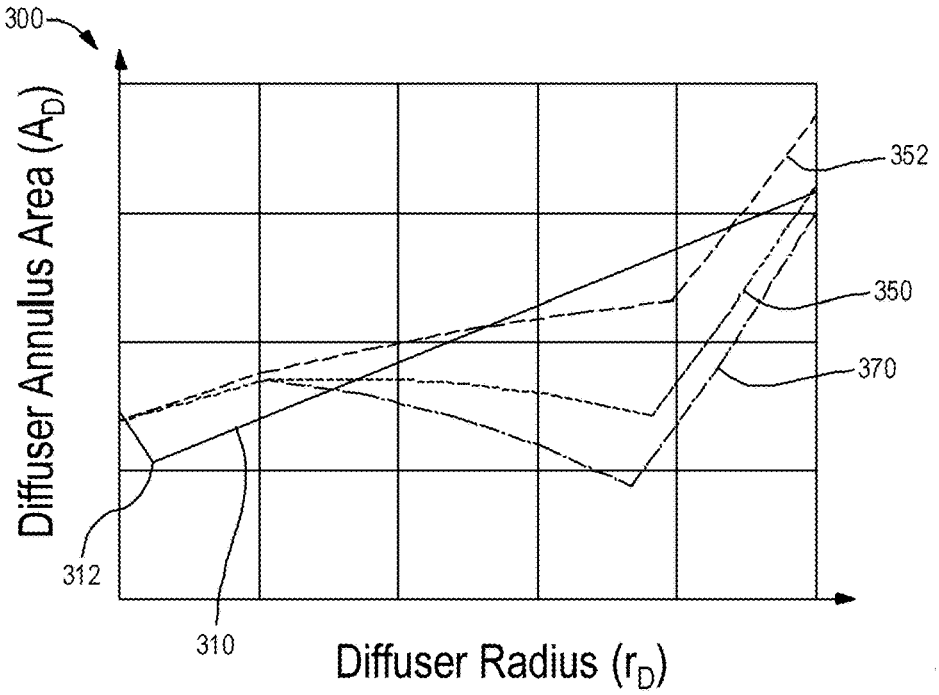
FIG. 3 is a graph of diffuser annulus area versus diffuser radius for diffusers of the compressor of FIG. 2.

FIG. 3 presents a graph 300 representing the diffuser annulus area $A_D$ versus the diffuser radius $r_D$ of diffusers of various designs, including controlled area progression diffusers in accordance with the present disclosure. A line 310 represents an area progression of the diffuser 70 of the conventional compressor 32 as the diffuser radius $r_D$ increases. Initially, the diffuser width $w_D$ and the corresponding diffuser annulus area $A_D$ decrease in the diffuser inlet 80 as the compressor housing 64 converges toward the compressor wheel tip 78 and the bearing housing 60 until reaching a pinch point 312 as shown. After the pinch point 312, the diffuser width $w_D$ remains constant and the diffuser faces 74, 76 remain parallel as the diffuser radius $r_D$ increases and the diffuser annulus area $A_D$ increases linearly until the diffuser 70 intersects with the volute 72. While the compressor 32 is illustrated and described as having pinch point 312 at the diffuser inlet 80, other compressors 32 may not have a pinch point 312. In such compressors 32, the compressor chamber 62 transitions through the diffuser inlet 80 to the diffuser 70 without creating a pinch. With or without a pinch point 312, the diffuser faces 74, 76 are parallel from with a fixed diffuser width $w_D$ from the diffuser inlet 80 to the diffuser outlet 82 in conventional compressors 32.

Figure 4:
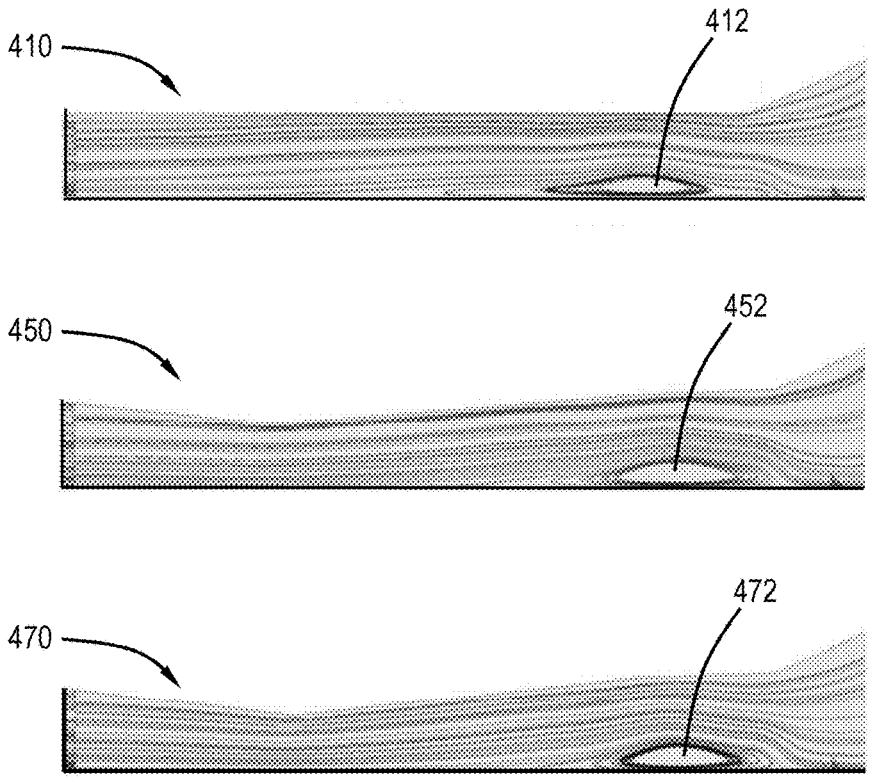
FIG. 4 is airflow maps for diffusers that may be implemented in the compressor of FIG. 2.

The airflow through the diffusers at low mass flow rates is illustrated in FIG. 4. An airflow map 410 for the diffuser 70 represents airflow from right to left through the diffuser 70. Due to low mass flow rates, the flowing air may separate from one or both of the diffuser faces 74, 76. The location of air separation may occur at varying locations along the diffuser 70 depending on dimensions of the diffuser 70, the operating conditions for the compressor 32 as well as other factors. As illustrated, a separation bubble 412 may form along the bearing diffuser face 74 within the diffuser 70. As the size of the separation bubble 412 increases, the efficiency of the compressor 32 is reduced and instability created by the separation bubble 412 can lead to surging as described above. Diffusers in accordance with the present disclosure are designed to control the annulus area progression of the diffuser in a manner that reduces efficiency losses by suppressing the size of separation bubbles, shifting the location of the separation bubbles, and/or lowering the mass flow rates at which airflow separations from the diffuser faces and forms separation bubbles.

Figure 5:
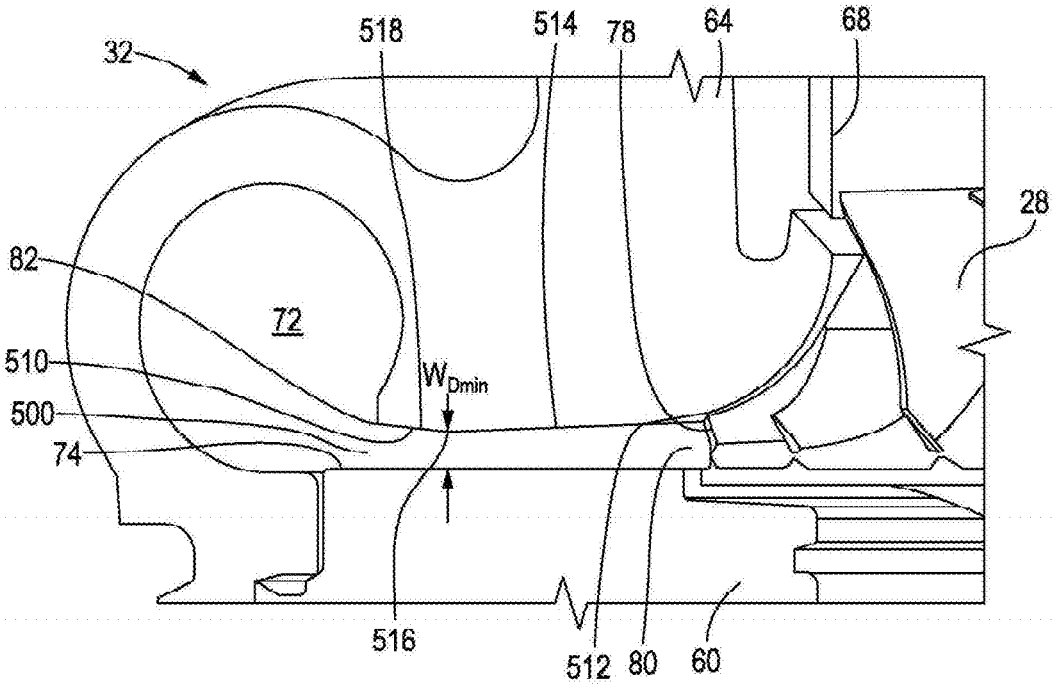
FIG. 5 is the partial cross-sectional view of FIG. 2 of the compressor with an embodiment of a controlled area progression diffuser in accordance with the present disclosure.

In the present embodiments, the area progression is controlled by varying the diffuser width $w_D$ as the diffuser extends from the diffuser inlet 80 to the volute 72. FIG. 5 illustrates a first embodiment of the compressor 32 wherein a controlled area progression diffuser 500 has a varying diffuser width $w_D$ created by a compressor diffuser face 510 that is contoured relative to the bearing diffuser face 74. The compressor diffuser face 510 may initially be parallel to the bearing diffuser face 74 until reaching a first transition point 512 after which a first face portion 514 that reduces the diffuser width $w_D$ at a constant rate as the first face portion 514 extends radially outward from the first transition point 512 until reaching a minimum diffuser width $w_{Dmin}$ at a second transition point 516. After the second transition point 516, a second face portion 518 of the compressor diffuser face 510 may increase the diffuser width $w_D$ at a constant rate as the second face portion 518 extends to the outlet of the diffuser 500 to the volute 72. This expansion of the diffuser 500 after the second transition point 516 leads to the same or similar exit area ratio at the outlet to the volute 72, and the same or similar pressure ratios, as achieved in compressors with conventional diffusers. This design increases diffusion of the air flowing out of the diffuser 500 and into the volute 72 and may result in higher efficiency.

Referring back to FIG. 3, a line 350 represents the annulus area progression of the diffuser 500. In this embodiment, the diffuser annulus area $A_D$ increases at a lower rate initially than the line 310 for the exemplary or baseline diffuser 70 due to the decreasing diffuser width $w_D$ until the second transition point 516, after which the diffuser annulus area $A_D$ increases at a higher rate than the line 310 until reaching the outlet of the diffuser 500. Additionally, because both the diffuser radius $r_D$ and the diffuser width $w_D$ are changing in the annulus area Eq. (1), the sections of the annulus area progression line 350 corresponding to the face portions 514, 518 have curved shapes indicating a non-linear annulus area progression as the diffuser radius $r_D$ increases. A line 352 represents an implementation of the diffuser 500 with the location of the second transition point 516 shifted radially outward and with a large minimum diffuser width $w_{Dmin}$ at a second transition point 516 (i.e., the second transition point 516 creates less constriction in the diffuser 500). The diffuser annulus area $A_D$ still increases non-linearly at a lower rate initially than the line 310, but at a higher rate than the same portion of the line 350. After the second transition point 516, the diffuser annulus area $A_D$ increases at a higher rate than the line 310. Other embodiments of controlled area progression diffusers may have linear and/or non-linear annulus area progressions in part or in whole. It should also be noted that the design of the diffuser 500 and other controlled area progression diffusers in accordance with the present disclosure may not include the pinch point 312 that was present in some previously-known diffusers such as the diffuser 70. In FIG. 4, an airflow map 450 for the diffuser 500 shows that a separation bubble 452 may form closer to the diffuser inlet 80 than the separation bubble 412 for the diffuser 70.

Figure 6:
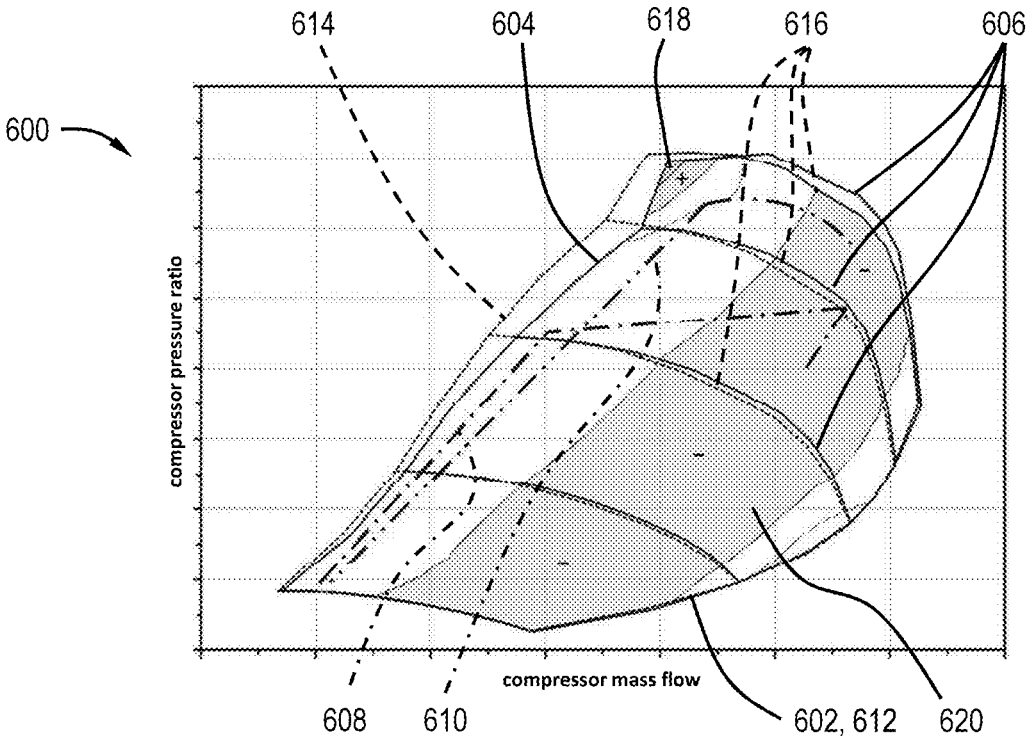
FIG. 6 is a graph of compressor pressure ratio versus compressor mass flow comparing the diffuser of the compressor of FIG. 2 and the diffuser of the compressor of FIG. 5.

FIG. 6 presents a graph 600 of a compressor pressure ratio (outlet pressure over inlet pressure) versus compressor mass flow. The graph 600 represents a comparison of simulation data for the operation of the compressor 32 with the baseline diffuser 70 and the controlled area progression diffuser 500 of FIG. 5. In the graph 600, a choke line 602 defines a maximum compressor mass flow rate of the compressor 32 with the diffuser 70 above which the high flow rate and low compressor pressure ratio may cause the compressor 32 to choke. A surge line 604 for the diffuser 70 may define the minimum compressor mass flow rate below which the discharge process may be interrupted. Lines 606 may represent combinations of compressor pressure ratios and corresponding compressor mass flows for various rotational speeds of the compressor wheel 28.

The graph 600 further includes a first lug line 608 representing the compressor operating conditions for an exemplary engine running at peak torque at various engine speeds. For purposes of evaluating the performance of various controlled area progression diffusers in accordance with the present disclosure relative to the diffuser 70, simulation data may be most relevant in the area from the lug line 608 to the surge line 604 where the compressor 32 normally operates. A second lug line 610 may represent the compressor operating conditions for a second exemplary engine or for the first exemplary engine running at peak torque under different engine operating conditions. There are a multitude of factors that determine the lug line for a particular engine in a particular operating environment. Such factors can include the engine itself, the manner in which the engine is operated, emissions strategies, the environment in which the engine will operate, and the like. The combination of factors will dictate the location and shape of the lug line on the graph 600 of compressor operating conditions, and controlled area progression diffusers in accordance with the present disclosure facilitate tuning the performance of the compressor 32 to the operating requirements of the engine or other power source with which the compressor 32 is implemented.

The data for the diffuser 500 includes a choke line 612 that substantially overlaps with the choke line 602 in this comparison, a surge line 614 and constant compressor rotational speed lines 616. As shown by the data, the surge line 614 for the diffuser 500 is shifted to the left from the surge line 604 of the diffuser 70 indicating that diffuser 500 will allow the compressor 32 to operate at lower compressor mass flow rates without encountering surging. The area between the surge lines 604, 614 represents operating conditions where the geometry of the diffuser 500 is having a meaningful effect to suppress the surge mechanism. This shift expands the map width of operating conditions under which the compressor 32 can function properly.

The data further shows that improvements in efficiencies can be achieved by controlled area progression diffusers in accordance with the present disclosure. In the graph 600 and similar graphs illustrated and discussed hereafter, increases in efficiency for the controlled area progression diffusers versus the previously known diffuser 70 are indicated by plus signs "+" in the shaded areas where darker shading and greater concentrations of plus signs indicating greater efficiency gains. Similarly, decreases in efficiency for the controlled area progression diffusers are indicated by minus signs "–" in the shaded areas. In the graph 600, an area 618 proximate the surge line 614 where the compressor operates at relatively high compression ratios and compressor wheel speeds indicates that efficiency of the compressor 32 may be greater with the diffuser 500 than the diffuser 70. These efficiency increases may be desirable in compressors 32 that operate in this range of compressor mass flow rates, pressure ratios and compressor wheel speeds. Efficiency gains, or at least comparable efficiencies, are found in a majority of the operating range of the compressor 32 with the diffuser 500 between the lug line 608 and the surge line 614. In contrast, the simulation data indicates lower efficiencies may be found at an area 620 between the lug line 608 and the choke line 612, which is outside the normal operating range for the compressor 32.

Figure 7:
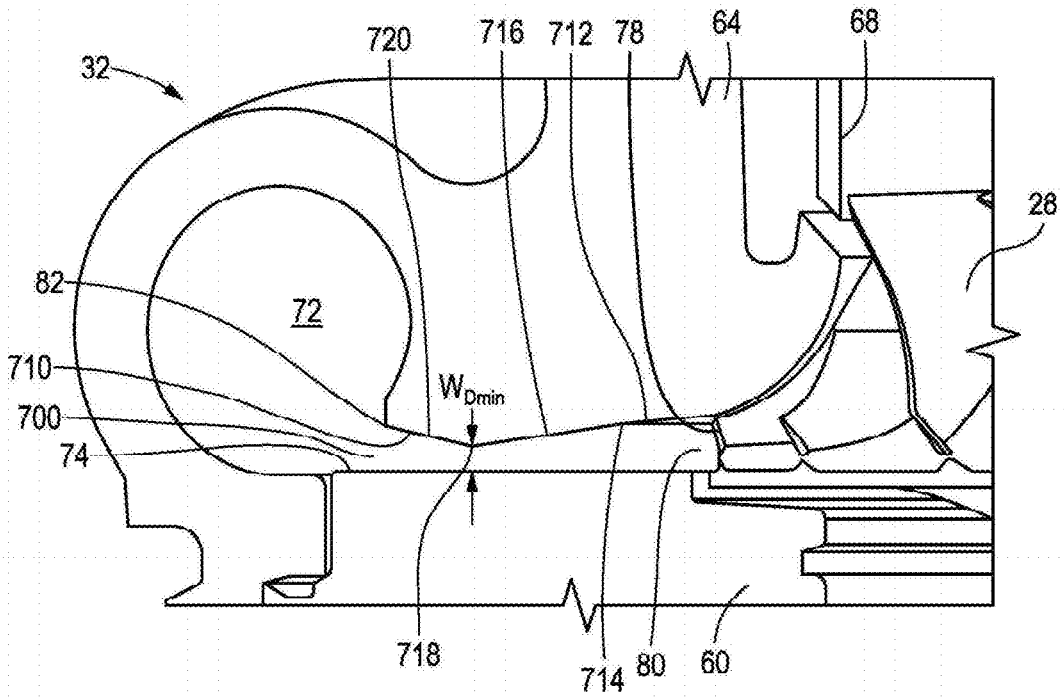
FIG. 7 is the partial cross-sectional view of FIG. 2 of the compressor with an alternative embodiment of a controlled area progression diffuser in accordance with the present disclosure.

FIG. 7 illustrates a second embodiment of the compressor 32 wherein a controlled area progression diffuser 700 has a varying diffuser width $w_D$ created by a compressor diffuser face 710 that is contoured relative to the bearing diffuser face 74 in a generally similar manner as the compressor diffuser face 510 of the diffuser 500. The compressor diffuser face 710 may include a first face portion 712 that reduces the diffuser width $w_D$ at a first constant rate as the first face portion 712 extends radially outward from the diffuser inlet 80 until reaching a first transition point 714. The first transition point 714 may be located radially outward of the location of the first transition point 512 in the diffuser 500 of FIG. 5. After the first transition point 714, a second face portion 716 of the compressor diffuser face 710 may reduce the diffuser width $w_D$ at a second constant rate that is greater than the first constant rate of the first face portion 712 as the second face portion 716 extends radially outward from the first transition point 714 until reaching the minimum diffuser width $w_{Dmin}$ at a second transition point 718. After the second transition point 718, a third face portion 720 of the compressor diffuser face 710 may increase the diffuser width $w_D$ at a constant rate as the third face portion 720 extends to the outlet of the diffuser 700 to the volute 72.

Referring back to FIG. 3, a line 370 represents the annulus area progression of the diffuser 700. In this embodiment, the diffuser annulus area $A_D$ increases at a lower rate initially than the line 310 for the baseline diffuser 70 due to the decreasing diffuser width $w_D$ until the first transition point 714. After the first transition point 714, the diffuser annulus area $A_D$ may actually decrease as the compressor diffuser face 710 extends between the transition points 714, 718 due to the increased rate of decrease of the diffuser width $w_D$. After the second transition point, 718, the diffuser annulus area $A_D$ increases at a higher rate than the line 310 until reaching the outlet of the diffuser 700. As with the line 350, the sections of the line 370 may have non-linear shapes. In FIG. 4, an airflow map 470 for the diffuser 700 shows that a separation bubble 472 may form closer to the diffuser inlet 80 than the separation bubble 412 for the diffuser 70, and may be smaller than the separation bubble 412.

Figure 8:
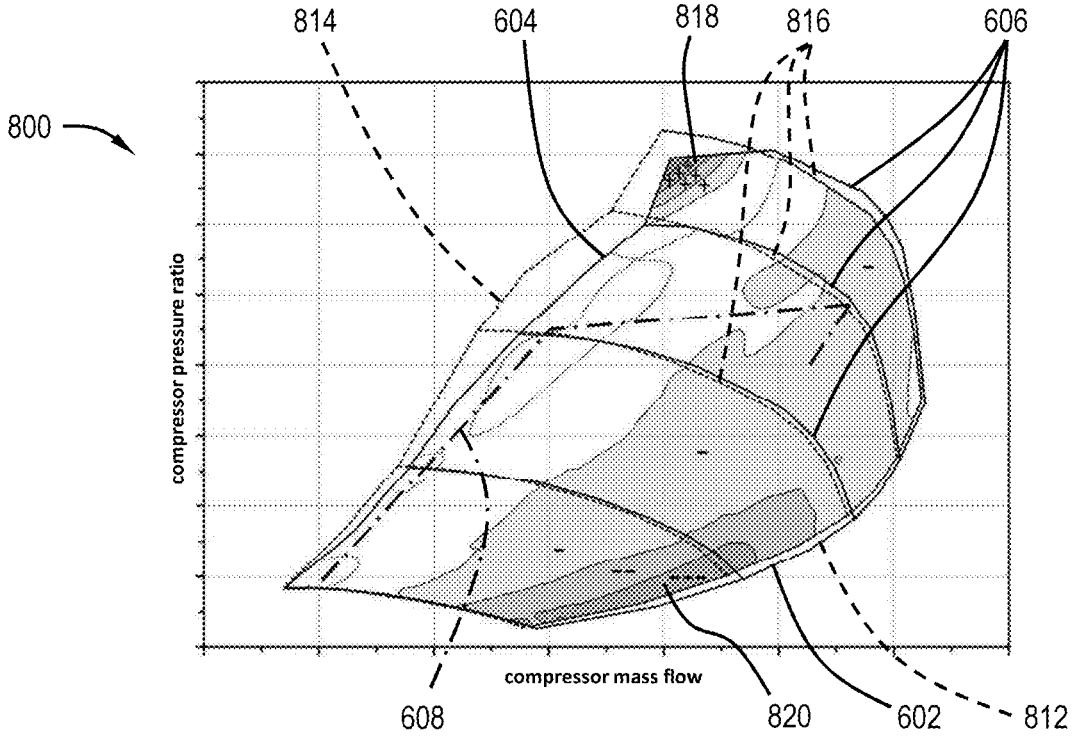
FIG. 8 is a graph of compressor pressure ratio versus compressor mass flow comparing the diffuser of the compressor of FIG. 2 and the diffuser of the compressor of FIG. 7.

FIG. 8 presents a graph 800 of the compressor pressure ratio versus compressor mass flow that includes the choke line 602, the surge line 604, and the constant compressor rotational speed lines 606 for the diffuser as well as a choke line 812, a surge line 814 and constant compressor rotational speed lines 816 for the diffuser 700 to present a comparison of the operation of the compressor 32 with the baseline diffuser 70 and the controlled area progression diffuser 700 of FIG. 7. As with the surge line 614 for the diffuser 500, the surge line 814 for the diffuser 700 is shifted to the left from the surge line 604 of the diffuser 70 to indicate additional operating conditions at lower compressor mass flow rates for the compressor 32 to operate without encountering surging. Additionally, similar efficiency increases as shown in FIG. 6 may be achieved at an area 818 near the surge line 814 where the compressor 32 operates at relatively high compression ratios and compressor wheel speeds. Conversely, efficiency decreases may be found in a majority of the operating range of the compressor 32 below the lug line 608 with the diffuser 700, and in particular in an area 820 proximate the choke line 812.

Figure 9:
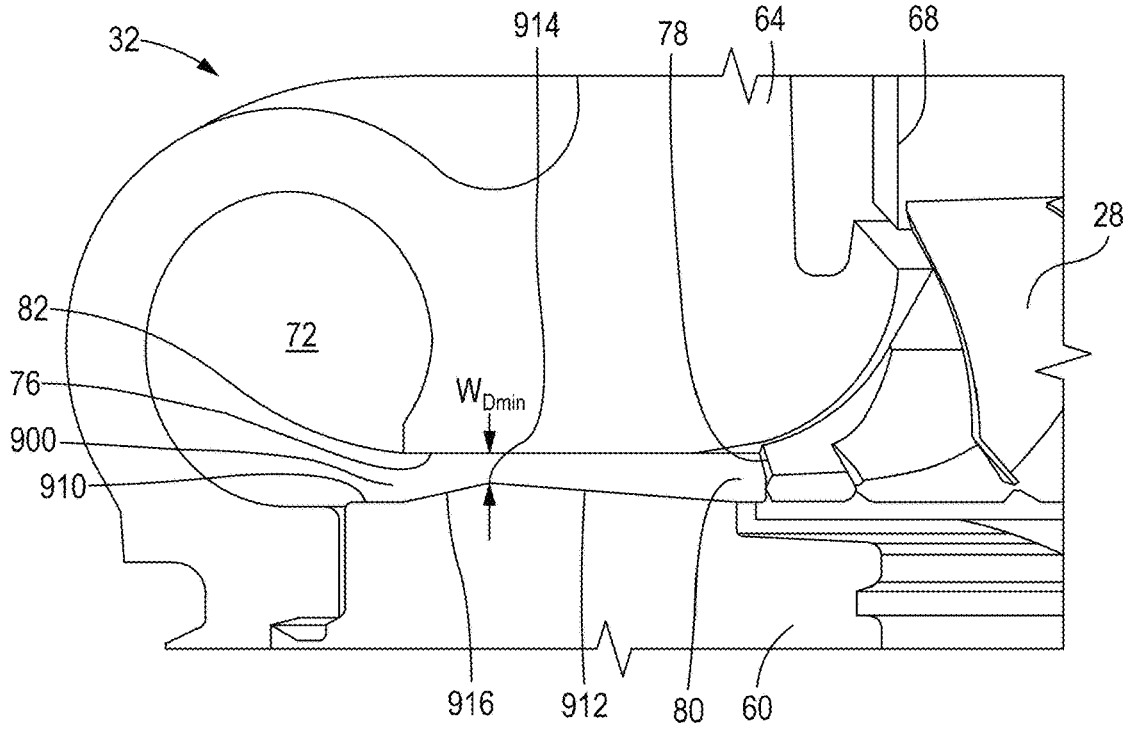
FIG. 9 is the partial cross-sectional view of FIG. 2 of the compressor with another embodiment of a controlled area progression diffuser in accordance with the present disclosure.

While the controlled area progression diffusers 500, 700 are illustrated and described herein as having compressor diffuser faces 510, 710 that are shaped to control the annulus area progression of the diffusers 500, 700 while the bearing diffuser face 74 remains generally planar, those skilled in the art will understand that the bearing diffuser face 74 may be shaped to similarly control the annulus area progression of diffusers and the suppression of separation bubbles while the compressor diffuser face 76 remains generally planar. FIG. 9 illustrates a further embodiment of the compressor 32 wherein a controlled area progression diffuser 900 has a varying diffuser width $w_D$ created by a compressor diffuser face 910 that is contoured relative to the compressor diffuser face 76. The compressor diffuser face 910 may have a similar as the compressor diffuser face 510 but implemented on the opposite side of the diffuser 900. The compressor diffuser face 910 includes a first face portion 912 that reduces the diffuser width $w_D$ at a constant rate as the first face portion 912 extends to a transition point 914, and a second face portion 916 that increases the diffuser width $w_D$ at a constant rate as the second face portion 916 extends to the outlet of the diffuser 900 to the volute 72. In contrast to the diffuser 500, the first face portion 912 decreases the diffuser width $w_D$ at a greater rate, and the minimum diffuser width $w_{Dmin}$ at the transition point 914 is less than at the transition point 514. Those skilled in the art will understand that both the value of the minimum diffuser width $w_{Dmin}$ and the radial position of the transition point 914 within the diffuser 900 and other diffuser embodiments may be varied as necessary to achieve optimum performance of a compressor in which controlled area progression of diffusers in accordance with the present disclosure is implemented. Such shape variations of the controlled area progression diffusers are contemplated by the inventors.

Figure 10:
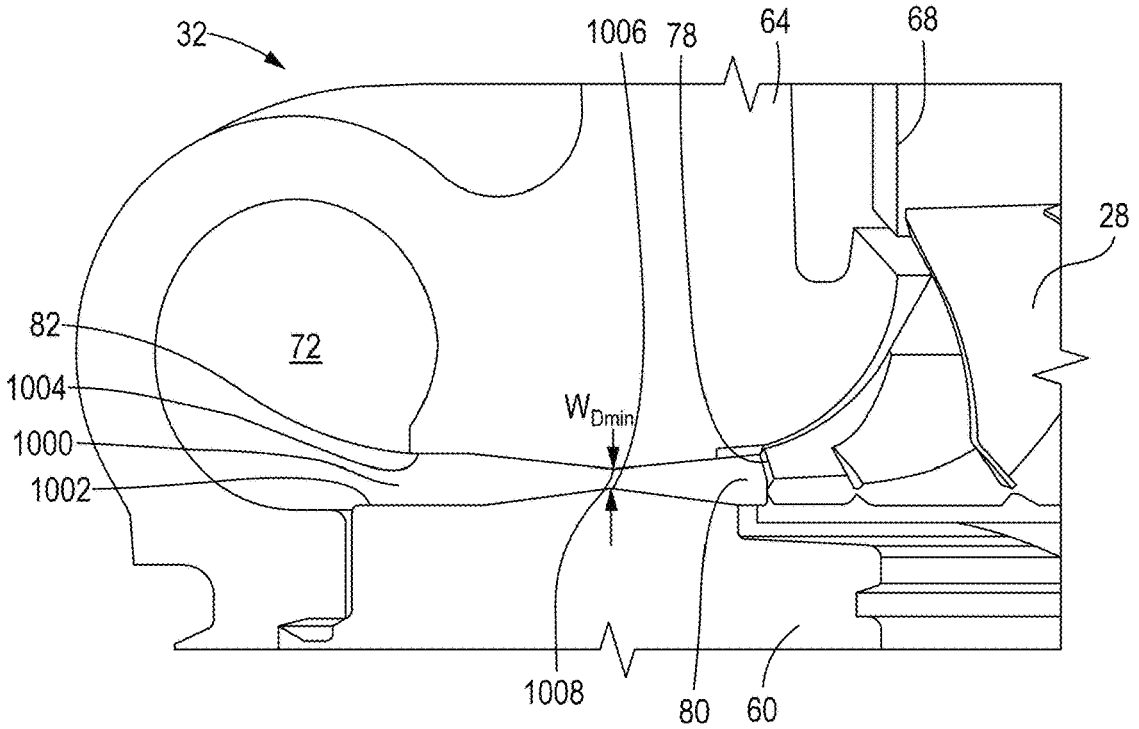
FIG. 10 is the partial cross-sectional view of FIG. 2 of the compressor with a further alternative embodiment of a controlled area progression diffuser in accordance with the present disclosure.

Additional embodiments of diffusers are contemplated where both diffuser faces are shaped to control the annulus area progression of diffusers. For example, FIG. 10 illustrates an alternative embodiment of the compressor 32 wherein a controlled area progression diffuser 1000 is defined by a bearing diffuser face 1002 and a compressor diffuser face 1004 that are both shaped to control the annulus area progression of the diffuser 1000. The diffuser faces 1002, 1004 may be similar to the diffuser faces 510, 910 and be piece-wise surfaces formed from face portions that meet at transition points 1006, 1008 where the diffuser width w D has a minimum value.

Figure 11:
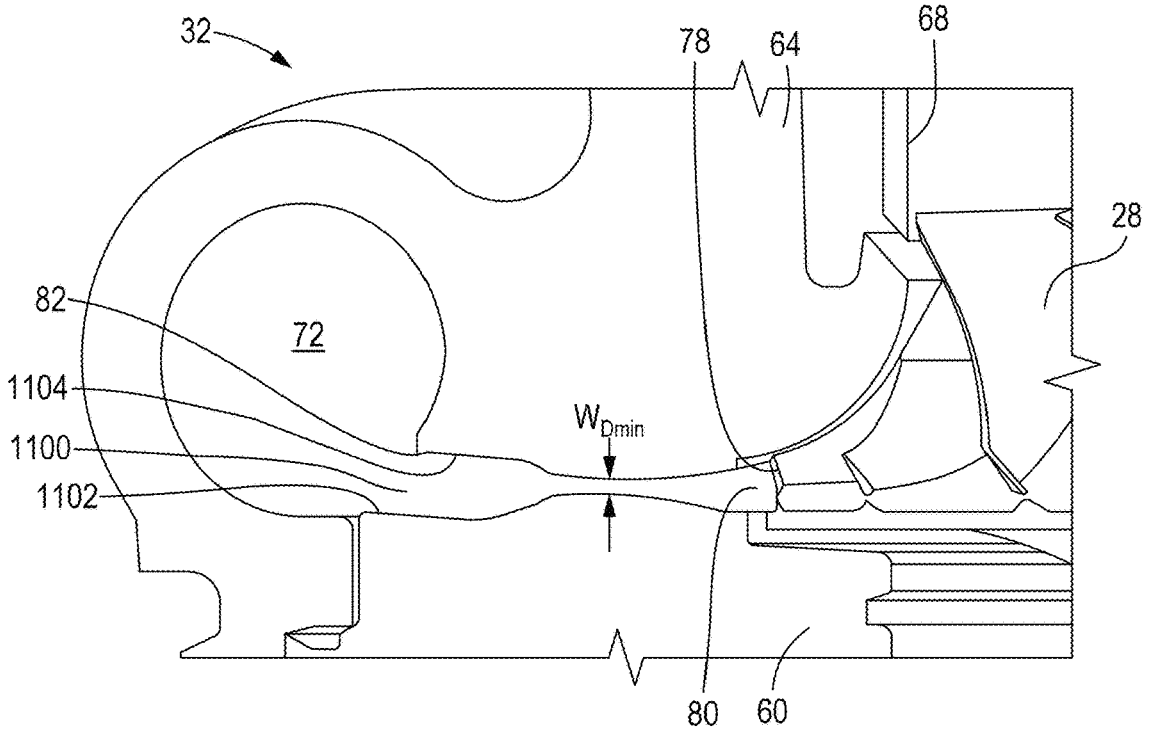
FIG. 11 is the partial cross-sectional view of FIG. 2 of the compressor with an additional embodiment of a controlled area progression diffuser in accordance with the present disclosure.

FIG. 11 illustrates a further alternative embodiment of the composer wherein a controlled area progression diffuser 1100 is defined by a bearing diffuser face 1102 and a compressor diffuser face 1104 that are both shaped to control the annulus area progression of the diffuser 1100. In this embodiment, the diffuser faces 1102, 1104 converge to a minimum diffuser width $w_{Dmin}$. In contrast, however, the diffuser faces 1102, 1104 are curved surfaces that converge to the area of minimum diffuser width $w_{Dmin}$ and then diverge to the outlet of the diffuser 1100 to the volute 72. Due to the curvature of the diffuser faces 1102, 1104, the diffuser width $w_D$ will change at a non-linear or variable rate as the diffuser faces 1102, 1104 extend away from the diffuser inlet 80 such that a line on the diffuser annulus area $A_D$ versus the diffuser radius $r_D$ graph 300 of FIG. 3 will have curved lines indicating non-linear changes to the diffuser annulus are $A_D$ during the diffuser area progression from the diffuser inlet 80 to the volute 72.

Figure 12:
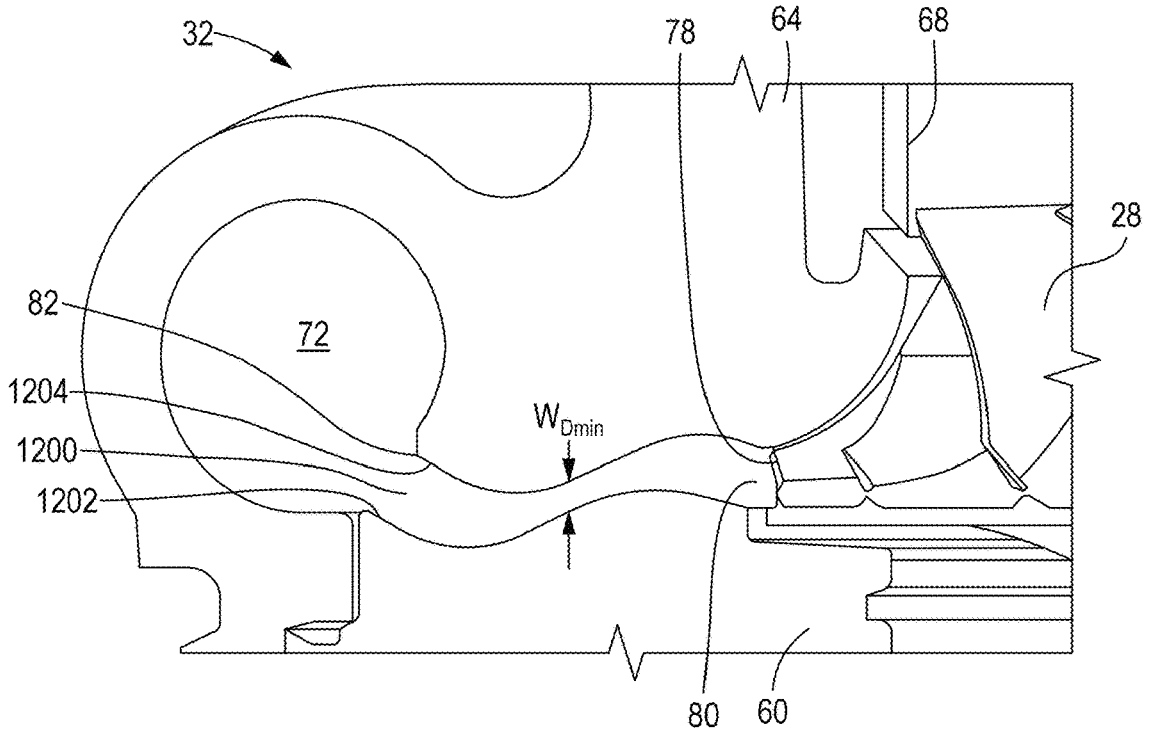
FIG. 12 is the partial cross-sectional view of FIG. 2 of the compressor with a further alternative embodiment of a controlled area progression diffuser in accordance with the present disclosure.

The diffusers 1000, 1100 as illustrated may be generally symmetrical about a plane perpendicular to the rotational axis A and extending through an axial center of the diffusers 1000, 1100. However, embodiments are contemplated where diffusers do not necessarily have such symmetry. For example, FIG. 12 illustrates a still further embodiment of the compressor 32 with a controlled area progression diffuser 1200 having a bearing diffuser face 1202 and a compressor diffuser face 1204 with complimentary shapes forming a spline path to the volute 72. The relative curvatures of the diffuser faces 1202, 1204 is configured so that the diffuser width $w_D$ changes as the diffuser 1200 extends radially and has a desired minimum diffuser width $w_{Dmin}$ at an appropriate radial distance. The contours of the diffuser faces 1202, 1204 are exemplary, and the diffuser 1200 may be configured with alternative shapes to achieve a desired efficiency of operation of the compressor 32.

Figure 13:
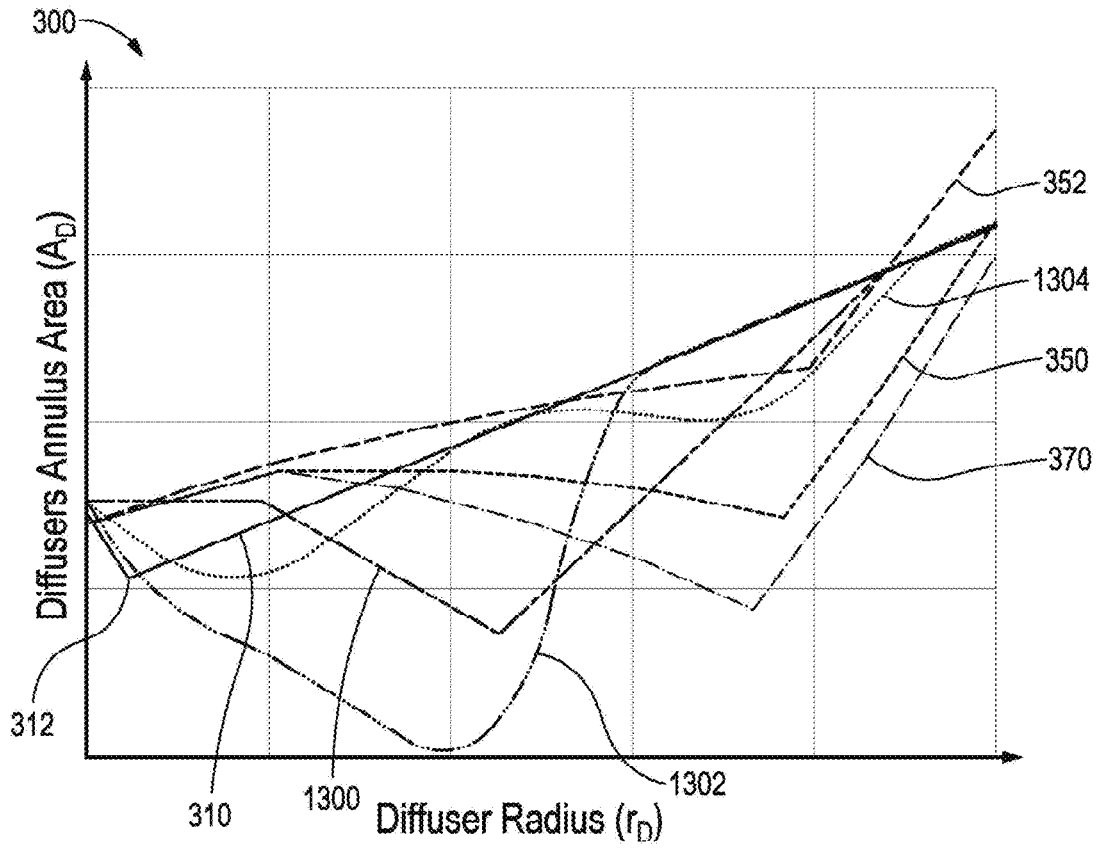
FIG. 13 is the graph of FIG. 3 with annular area progression lines for the diffusers of FIGS. 9-12.
Figure 14:
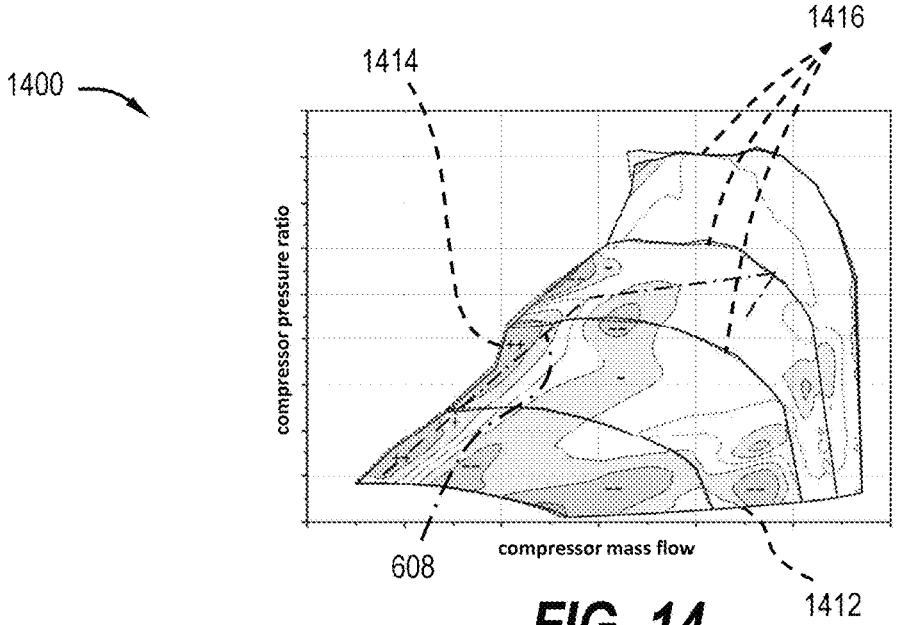
FIG. 14 is a graph of compressor pressure ratio versus compressor mass flow comparing the diffuser of the compressor of FIG. 2 and the diffuser of the compressor of FIG. 9.

FIG. 13 presents the graph 300 of FIG. 3 with additional lines 1300, 1302, 1304 representing the annular area progressions of the diffusers 1000, 1100, 1200 of FIGS. 10-12, respectively. As shown by line 1300, the diffuser annulus area $A_D$ of the diffuser 1000 may be approximately constant initially as the diffuser 1000 extends radially away from the compressor wheel tip 78. The diffuser annulus area $A_D$ may decrease as the diffuser 1000 progresses further toward the transition point 1008, and then increase as the diffuser width $w_D$ increases beyond the transition point 1008 until the area proximately diffuser outlet 82 where diffuser annulus area $A_D$ may decrease at a lower rate as the diffuser width $w_D$ is approximately constant.

The line 1302 graphically illustrates that the curvature of the diffuser faces 1102, 1104 causing the diffuser width $w_D$ to change at a non-linear or variable rate as the diffuser faces 1102, 1104 extend away from the diffuser inlet 80 creates a curved line on the diffuser annulus area $A_D$ versus the diffuser radius $r_D$ graph 300. The curvature of the line 1302 indicates non-linear and non-parabolic changes to the diffuser annulus are $A_D$ during the diffuser area progression from the diffuser inlet 80 for much of the radial distance to the volute 72. The line 1304 for the diffuser 1200 also indicates diffuser contours creating non-linear and non-parabolic changes to the diffuser annulus are $A_D$ during the diffuser area progression. These types of progressions of the diffuser annulus area $A_D$ can be tailored for particular compressors 32 to optimize their performance.

FIGS. 14-17 are similar to FIGS. 6 and 8 in providing graphical comparisons of simulation data for the compression pressure ratio versus compressor mass flow for the diffusers 900, 1000, 1100 and 1200 of FIGS. 9-12 versus a baseline diffuser having a constant diffuser width w D. In the graph 1400 of FIG. 14, the lug line 608, a choke line 1412, a surge line 1414 and constant compressor speed lines 1416 are provided in a similar manner as discussed above. The data may indicate improved efficiency between the lug line 608 and the surge line 1414 at lower compressor wheel speeds. Efficiency may be worse at the surge line 1414 at mid-range compressor wheel speeds just below the lug line 608, and may be comparable or slightly worse near a choke line 1412 at relatively low compressor wheel speeds. Performance in the interior of the graph 1400 may be comparable between the diffusers 70, 900. Of course, those skilled in the art will understand that the radial position of the transition point 914 and the minimum diffuser width $w_{Dmin}$ can be varied to adjust the performance of the diffuser 900 to better meet the operating requirements for a given compressor 32.

Figure 15:
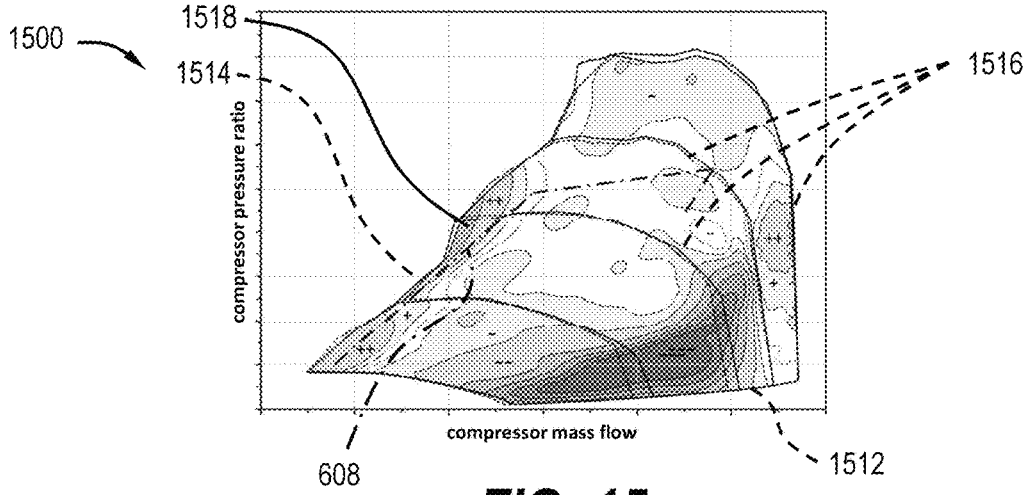
FIG. 15 is a graph of compressor pressure ratio versus compressor mass flow comparing the diffuser of the compressor of FIG. 2 and the diffuser of the compressor of FIG. 10.

FIG. 15 illustrates a graph 1500 for the controlled area progression diffuser 1000 of FIG. 10 and includes the lug line 608, a choke line 1512, a surge line 1514 and constant compressor speed lines 1516. The illustrated diffuser 1000 may show improved efficiency in an area 1518 proximate the surge line 1514 up to mid-range compressor wheel speeds. However, in the simulated design, signification choke flow and efficiency reduction may occur in the area of the choke line 1512. As with the other diffuser embodiments, the diffuser 1000 in accordance with the present disclosure provides flexibility for modification of multiple parameters in its geometry as necessary to reduce or eliminate the efficiency variations in the choke flow regions and to improve efficiency in other areas of the graph 1500.

Figure 16:
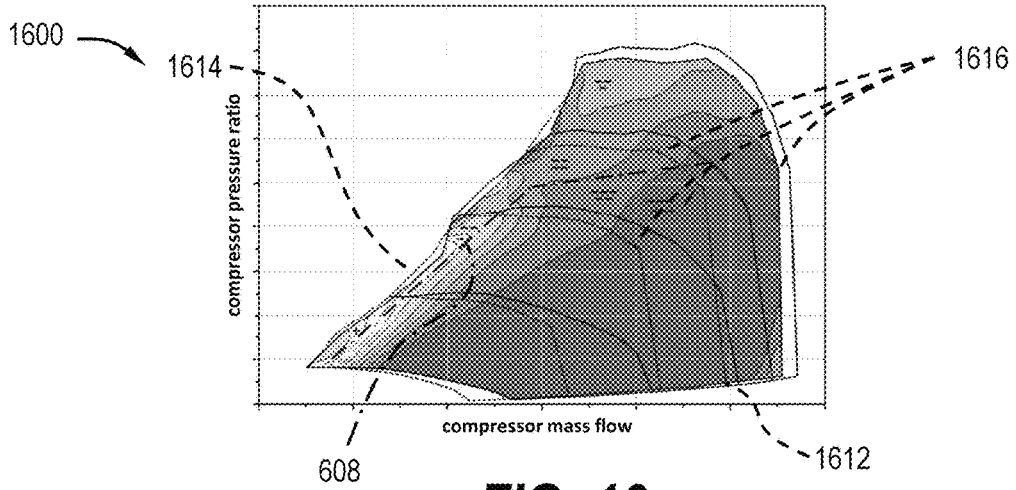
FIG. 16 is a graph of compressor pressure ratio versus compressor mass flow comparing the diffuser of the compressor of FIG. 2 and the diffuser of the compressor of FIG. 11.

FIG. 16 illustrates a graph 1600 for the controlled area progression diffuser 1100 of FIG. 11 and includes the lug line 608, a choke line 1612, a surge line 1614 and constant compressor speed lines 1616. The graph 1600 illustrates that the design of the diffuser 1100 as shown in FIG. 11 may have too much contraction leading to the minimum diffuser width $w_{Dmin}$ so that flow through that configuration of the diffuser 1100 gets choked and efficiency is reduced across most operation conditions within the graph 1600. The flexibility of the design allows the performance of the diffuser 1100 to be improved by increasing the minimum diffuser width $w_{Dmin}$ and adjusting the curvature of the diffuser faces 1102, 1104 to tune the diffuser 1100 to the operating conditions of the compressor 32 in which the diffuser 1100 is implemented.

Figure 17:
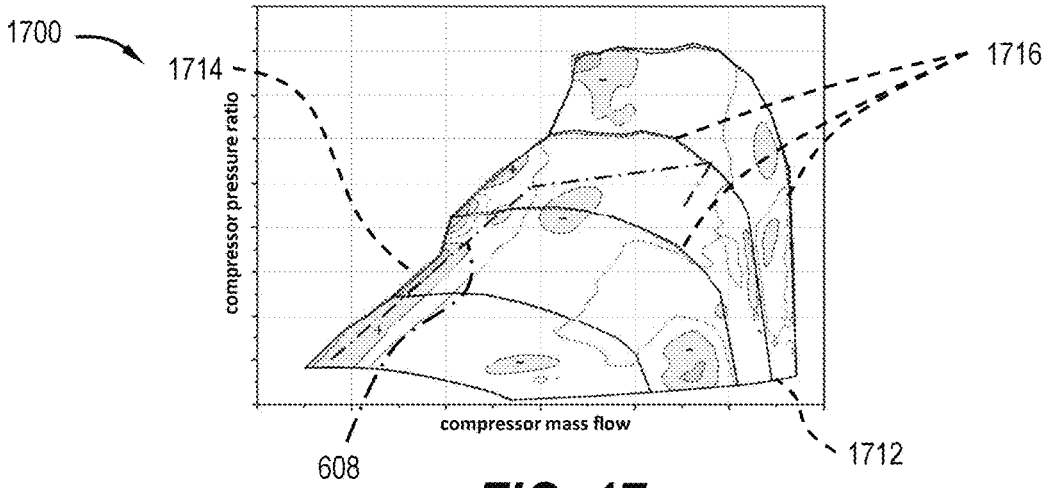
FIG. 17 is a graph of compressor pressure ratio versus compressor mass flow comparing the diffuser of the compressor of FIG. 2 and the diffuser of the compressor of FIG. 12.

In FIG. 17, which illustrates a graph 1700 for the controlled area progression diffuser 1200 of FIG. 12 and includes the lug line 608, a choke line 1712, a surge line 1714 and constant compressor speed lines 1716, the data indicates that the wavy diffuser 1200 as illustrated provides performance that is largely comparable to the performance of the baseline diffuser 70. From this point, the design of the diffuser 1200 can be optimized by adjusting the shapes and spacing of the diffuser faces 1202, 1204 to provide improved efficiencies in the areas of the graph 1700 that may be most critical to the operation of the compressor 32.

INDUSTRIAL APPLICABILITY

Controlled area progression diffusers in accordance with the present disclosure may allow compressors of turbochargers to operate more efficiently at low compressor mass flows, and reduce the occurrences of surging during low mass flow conditions. By shaping the diffuser face(s) to vary the diffuser width $w_D$ and control the annulus area progression of the diffuser, separation of air from the diffuser faces at low mass flows can be suppressed and the amount of separation may be reduced to reduce drag within the diffuser and maintain efficiency of the compressor under such conditions. Controlled area progression allows controlled pressure in the diffuser that leads to suppression of separation and instability in the diffuser, which can improve efficiency.

Figure 18:
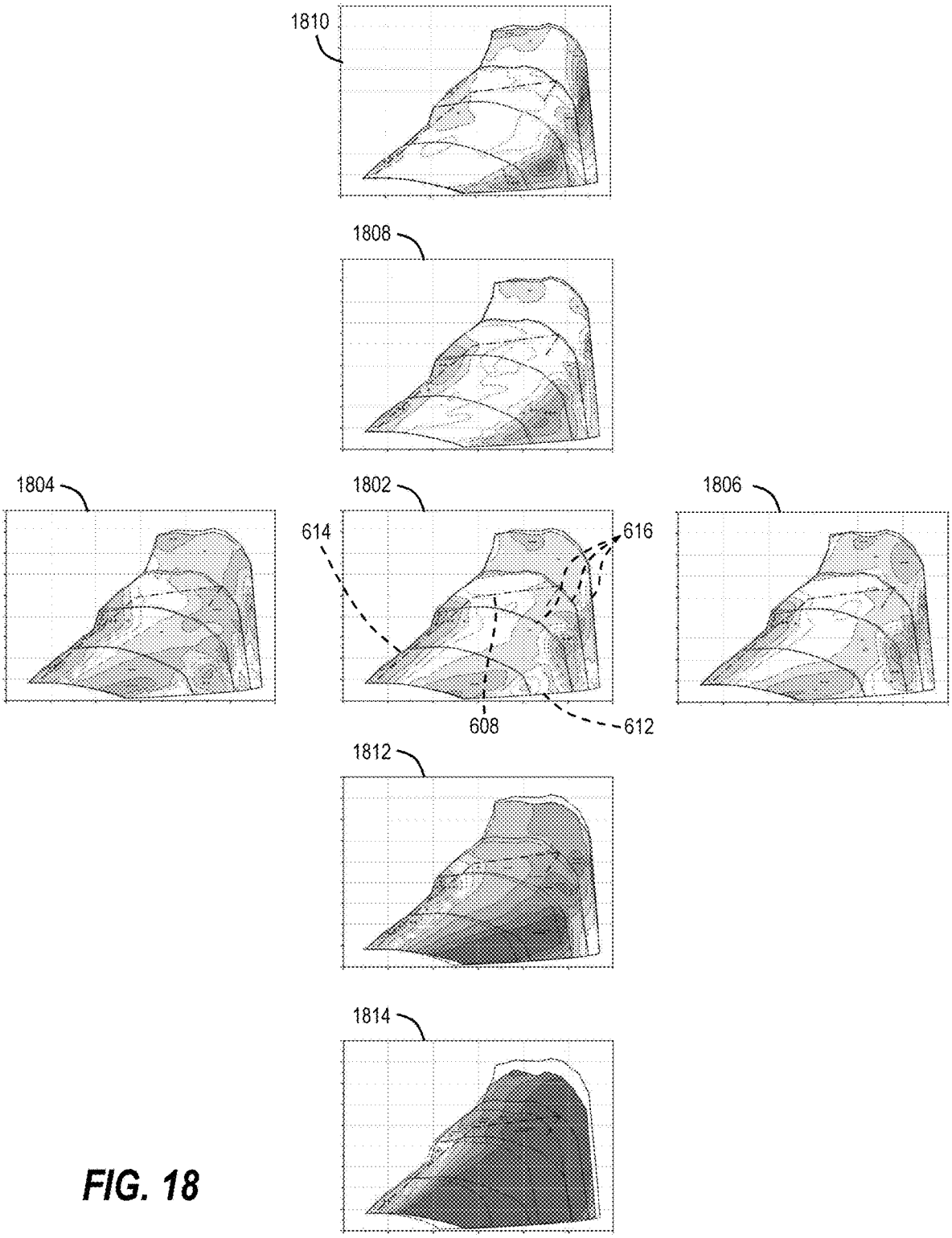
FIG. 18 is graphs of compressor pressure ratio versus compressor mass flow comparing the diffuser of the compressor of FIG. 2 and the diffuser of the compressor of FIG. 7 at different values of a radial position and a diffuser width of a transition point.

Previously known diffusers 70 provided two variables for controlling their performance within the compressor: the diffuser width $w_D$ and the radial length of the diffuser 70. Controlled area progression diffusers in accordance with the present disclosure provide greater flexibility in tuning the diffuser to improved the efficiency of compressors 32 by contouring the shapes of the bearing diffuser face and/or the compressor diffuser face. FIG. 18 illustrates the design flexibility provided by the controlled area progression diffusers in accordance with the present disclosure through a series of graphs 1802-1814. Each graph 1802-1814 is similar to the graph 600 of FIG. 6 for the diffuser 500 with adjustments to the compressor diffuser face 510 to change the radial position and the minimum diffuser width $w_{Dmin}$ of the second transition point 516, and thereby alter the performance of the diffuser 500 within the compressor 32. Graph 1802 illustrates simulation performance data for the diffuser 500 with nominal values for the radial position and the minimum diffuser width $w_{Dmin}$ of the second transition point 516 compared to the previously-know diffuser 70. In this iteration of the design of the diffuser 500, improved efficiency may be found proximate the surge line 614 up to mid-range compressor wheel speeds, and in an area 1802 proximate the choke line 612 at mid-range compressor speeds. At the same time, decreased efficiency may occur at relatively high compressor mass flow rates and high compressor speeds.

In graph 1804, the design of the diffuser 500 is varied by shifting the transition point 514 radially outward toward the diffuser outlet 82. After this adjustment, the diffuser 500 has similar efficiency gains in the area between the lug line 608 and the surge line 614, but with less the efficiency improvement near the choke line 612. Similar efficiency losses may be found in the area of high compressor inlet flow rates and high compressor speeds. Graph 1806 illustrates a variation where the second transition point 516 is shifted radially inward toward the diffuser inlet 80 by a similar distance from the nominal design as the second transition point 516 was shifted radially outward in graph 1804. The data for the graph 1806 shows similar results as the nominal profile of graph 1802. These results may provide a range of radial positions of the transition point 514 within which to work while adjusting other variables of the diffuser 500 to optimize the design for the compressor 32 in which the diffuser 500 is implemented.

Graph 1808 illustrates the graph 600 where the minimum diffuser width $w_{Dmin}$ at the transition point 514 of the nominal design has been increased. The adjustment of the minimum diffuser width $w_{Dmin}$ the diffuser 500 has similar increased the efficiency gains in the area of the choke line 612 at low to mid-range compressor wheel speeds. At the same time, efficiency improvements near the surge line 614 have been reduced, with some benefits being observed at low compressor wheel speeds and at mid-range compressor wheel speeds. In a graph 1810, the minimum diffuser width $w_{Dmin}$ is increased by twice the amount as in the graph 1808. As the restriction created at the second transition point 516 is further reduced, the efficiency gains along the choke line 612 continue to increase while the efficiency gains along the surge line 614 are further reduced.

In graph 1812, the minimum diffuser width $w_{Dmin}$ at the second transition point 516 has been decreased from the nominal value by a similar amount as the minimum diffuser width $w_{Dmin}$ was increased in the iteration of graph 1810. The efficiency gains along the surge line 614 in low to mid-range compressor wheel speeds are increased, but a large area of efficiency losses is developing along the choke line 612. Graph 1814 corresponds to the minimum diffuser width $w_{Dmin}$ being decreased by twice the amount as in the graph 1812 to further narrow the diffuser 500 at the second transition point 516. The data for graph 1814 shows too much contraction of the diffuser 500, resulting in flow getting choked by the second transition point 516.

Based on this data for the diffuser 500 in accordance with the present disclosure, the person skilled may further modify the design by changing the minimum diffuser width $w_{Dmin}$ and the radial position of the second transition point 516 within the ranges showing improved performance based on the data upon which the graphs 1802-1814 are based until an optimal design is developed for the operating ranges of the compressor 32 in which the diffuser 500 is implemented. The person skilled in the art may also explore other controlled area progression diffusers in accordance with the present disclosure, such as the diffusers 700, 900, 1000, 1100, 1200 illustrated and described herein, to find a design with a progression of the diffuser annulus area $A_D$ that yields the most optimal performance for the compressor 32 in which the controlled area progression diffuser in implemented.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. A controlled area progression diffuser for a compressor, wherein the compressor includes a bearing housing in which a shaft is supported by a bearing to rotate about a rotational axis, a compressor wheel disposed on the shaft, and a compressor housing connected to the bearing housing, defining a chamber within which the compressor wheel rotates and a volute for receiving airflow generated by the compressor wheel, the controlled area progression diffuser comprising:

a bearing diffuser face of the bearing housing having an annular shape and extending from the chamber to the volute;

a compressor diffuser face of the compressor housing having an annular shape and extending from the chamber to the volute, wherein the bearing diffuser face and the compressor diffuser face are spaced apart by a diffuser width that is parallel to the rotational axis of the compressor wheel;

a diffuser inlet proximate the chamber; and a diffuser outlet proximate the volute, wherein the airflow from the compressor wheel enters the controlled area progression diffuser through the diffuser inlet, between the bearing diffuser face and the compressor diffuser face, and flows out of the diffuser outlet to the volute, and wherein the bearing diffuser face and the compressor diffuser face are shaped so that the diffuser width decreases as the controlled area progression diffuser extends radially away from the chamber toward the volute so that an annulus area of the controlled area progression diffuser does not increase linearly for at least a portion of a radial length of the controlled area progression diffuser, wherein the compressor diffuser face comprises:

a first face portion extending from the diffuser inlet and axially approaching the bearing diffuser face at a first constant rate as the first face portion extends radially outward, a first transition point at a radially outward end of the first face portion, a second face portion extending radially outward from the first transition point and axially approaching the bearing diffuser face at a second constant rate that is greater than the first constant rate as the first face portion extends radially outward, a second transition point at a radially outward end of the second face portion at which the diffuser width is equal to a minimum diffuser width, and a third face portion extending radially outward from the second transition point and axially diverging from the bearing diffuser face at a constant rate as the third face portion extends radially outward.

2. The controlled area progression diffuser of claim 1, wherein the compressor diffuser face is shaped to axially approach the bearing diffuser face as the compressor diffuser face extends radially outward from the chamber.

3. The controlled area progression diffuser of claim 1, wherein the bearing diffuser face is shaped to axially approach the compressor diffuser face as the bearing diffuser face extends radially outward from the chamber.

4. The controlled area progression diffuser of claim 3, wherein the compressor diffuser face is shaped to axially approach the bearing diffuser face as the compressor diffuser face extends radially outward from the chamber.

5. A compressor comprising:

a bearing housing supporting a shaft by a bearing to rotate about a rotational axis;

a compressor wheel disposed on the shaft;

a compressor housing connected to the bearing housing and defining a chamber within which the compressor wheel rotates;

a volute for receiving airflow generated by the compressor wheel; and a controlled area progression diffuser defined by a bearing diffuser face of the bearing housing and a compressor diffuser face of the compressor housing, wherein the bearing diffuser face and the compressor diffuser face have annular shapes and extend from the chamber to the volute, wherein the controlled area progression diffuser includes a diffuser inlet proximate the chamber and a diffuser outlet proximate the volute such that the airflow from the compressor wheel flows through the controlled area progression diffuser to the volute, and wherein the controlled area progression diffuser is shaped so that a diffuser width between the bearing diffuser face and the compressor diffuser face decreases as the controlled area progression diffuser extends radially away from the chamber toward the volute so that an annulus area of the controlled area progression diffuser does not increase linearly for at least a portion of a radial length of the controlled area progression diffuser, wherein the compressor diffuser face comprises:

a first face portion extending from the diffuser inlet and axially approaching the bearing diffuser face at a first constant rate as the first face portion extends radially outward, a first transition point at a radially outward end of the first face portion, a second face portion extending radially outward from the first transition point and axially approaching the bearing diffuser face at a second constant rate that is greater than the first constant rate as the first face portion extends radially outward, a second transition point at a radially outward end of the second face portion at which the diffuser width is equal to a minimum diffuser width, and a third face portion extending radially outward from the second transition point and axially diverging from the bearing diffuser face at a constant rate as the third face portion extends radially outward.

6. The compressor of claim 5, wherein the bearing diffuser face is planar and the compressor diffuser face axially approaches the bearing diffuser face as the compressor diffuser face extends radially outward from the chamber.

7. The compressor of claim 5, wherein the compressor diffuser face is shaped to axially approach the bearing diffuser face as the compressor diffuser face extends radially outward from the chamber, and the bearing diffuser face is shaped to axially approach the bearing diffuser face as the bearing diffuser face extends radially outward from the chamber.

8. A turbocharger comprising:

a bearing housing in which a shaft is supported by a bearing to rotate about a rotational axis;

a compressor wheel disposed on the shaft;

a compressor housing connected to the bearing housing and defining a chamber within which the compressor wheel rotates;

a volute for receiving airflow generated by the compressor wheel; and a controlled area progression diffuser defined by a bearing diffuser face of the bearing housing and a compressor diffuser face of the compressor housing having annular shapes and extending from the chamber to the volute, the controlled area progression diffuser having a diffuser inlet proximate the chamber and a diffuser outlet proximate the volute so that the airflow from the compressor wheel enters through the diffuser inlet and exits through the diffuser outlet to the volute, and wherein the bearing diffuser face and the compressor diffuser face are shaped so that a diffuser width between the bearing diffuser face and the compressor diffuser face decreases as the controlled area progression diffuser extends radially away from the chamber toward the volute so that an annulus area of the controlled area progression diffuser does not increase linearly for at least a portion of a radial length of the controlled area progression diffuser, wherein the compressor diffuser face comprises:

a first face portion extending from the diffuser inlet and axially approaching the bearing diffuser face at a first constant rate as the first face portion extends radially outward, a first transition point at a radially outward end of the first face portion, a second face portion extending radially outward from the first transition point and axially approaching the bearing diffuser face at a second constant rate that is greater than the first constant rate as the first face portion extends radially outward, a second transition point at a radially outward end of the second face portion at which the diffuser width is equal to a minimum diffuser width, and a third face portion extending radially outward from the second transition point and axially diverging from the bearing diffuser face at a constant rate as the third face portion extends radially outward.

9. The turbocharger of claim 8, wherein the compressor diffuser face is shaped to axially approach the bearing diffuser face as the compressor diffuser face extends radially outward from the chamber.

10. The turbocharger of claim 8, wherein the bearing diffuser face is shaped to axially approach the compressor diffuser face as the bearing diffuser face extends radially outward from the chamber.

11. A controlled area progression diffuser for a compressor, wherein the compressor includes a bearing housing in which a shaft is supported by a bearing to rotate about a rotational axis, a compressor wheel disposed on the shaft, and a compressor housing connected to the bearing housing, defining a chamber within which the compressor wheel rotates and a volute for receiving airflow generated by the compressor wheel, the controlled area progression diffuser comprising:

a bearing diffuser face of the bearing housing having an annular shape and extending from the chamber to the volute;

a compressor diffuser face of the compressor housing having an annular shape and extending from the chamber to the volute, wherein the bearing diffuser face and the compressor diffuser face are spaced apart by a diffuser width that is parallel to the rotational axis of the compressor wheel;

a diffuser inlet proximate the chamber; and a diffuser outlet proximate the volute, wherein the airflow from the compressor wheel enters the controlled area progression diffuser through the diffuser inlet, between the bearing diffuser face and the compressor diffuser face, and flows out of the diffuser outlet to the volute, and wherein the bearing diffuser face and the compressor diffuser face are shaped so that an annulus area of the controlled area progression diffuser changes at a first rate as the controlled area progression diffuser extends radially away from the chamber toward the volute in a first portion of the controlled area progression diffuser, and the annulus area of the controlled area progression diffuser changes at a second rate as the controlled area progression diffuser extends radially away from the chamber toward the volute in a second portion of the controlled area progression diffuser, wherein the compressor diffuser face comprises:

a first face portion extending from the diffuser inlet and axially approaching the bearing diffuser face at a first constant rate as the first face portion extends radially outward, a first transition point at a radially outward end of the first face portion, a second face portion extending radially outward from the first transition point and axially approaching the bearing diffuser face at a second constant rate that is greater than the first constant rate as the first face portion extends radially outward, a second transition point at a radially outward end of the second face portion at which the diffuser width is equal to a minimum diffuser width, and a third face portion extending radially outward from the second transition point and axially diverging from the bearing diffuser face at a constant rate as the third face portion extends radially outward.

12. The controlled area progression diffuser of claim 11, wherein a first rate of change of the annulus area from the diffuser inlet to the first transition point is greater than a second rate of change of the annulus area from the first transition point to the second transition point.

13. The controlled area progression of the diffuser of claim 11, wherein a first rate of change of the annulus area from the first transition point to the second transition point is non-linear.

14. The controlled area progression of the diffuser of claim 11, wherein a first rate of change of the annulus area from the first transition point to the second transition point is parabolic.

* * * * *